US009629478B2

(12) United States Patent
Williams

(10) Patent No.: US 9,629,478 B2
(45) Date of Patent: Apr. 25, 2017

(54) INFANT FEEDING PILLOW

(71) Applicant: SHUGA BEBE COUTURE, LLC, Mount Pleasant, SC (US)

(72) Inventor: Kimberly Williams, Mount Pleasant, SC (US)

( * ) Notice: Subject to any disclaimer, the term of this patent is extended or adjusted under 35 U.S.C. 154(b) by 0 days.

(21) Appl. No.: 15/007,425

(22) Filed: Jan. 27, 2016

(65) Prior Publication Data

US 2016/0135611 A1 May 19, 2016

Related U.S. Application Data

(63) Continuation of application No. 14/733,405, filed on Jun. 8, 2015, now Pat. No. 9,271,581, which is a continuation-in-part of application No. 14/243,885, filed on Apr. 2, 2014, now Pat. No. 9,049,947.

(60) Provisional application No. 61/807,373, filed on Apr. 2, 2013.

(51) Int. Cl.
*A47G 9/10* (2006.01)
*A47D 13/08* (2006.01)

(52) U.S. Cl.
CPC ..... *A47D 13/083* (2013.01)

(58) Field of Classification Search
CPC ..... A47G 9/10
USPC ..... 5/655, 630, 632, 646
See application file for complete search history.

(56) References Cited

U.S. PATENT DOCUMENTS

| | | | | |
|---|---|---|---|---|
| 5,029,351 | A | 7/1991 | Weber | |
| 7,111,347 | B1 | 9/2006 | Cottrell | |
| 9,049,947 | B2 | 6/2015 | Williams | |
| 9,271,581 | B2 | 3/2016 | Williams | |
| 2002/0023301 | A1 * | 2/2002 | Vuuren | A47D 5/00 5/655 |
| 2012/0131751 | A1 | 5/2012 | Mahler | |
| 2015/0196136 | A1 | 7/2015 | Riddick | |

OTHER PUBLICATIONS

"U.S. Appl. No. 14/243,885, Non Final Office Action mailed Oct. 23, 2014", 8 pgs.
"U.S. Appl. No. 14/243,885, Notice of Allowance mailed Feb. 11, 2015", 5 pgs.
"U.S. Appl. No. 14/243,885, Response filed Jan. 6, 2015 to Non Final Office Action mailed Oct. 23, 2014", 11 pgs.
"U.S. Appl. No. 14/733,405, Ex Parte Quayle Action mailed Jul. 29, 2015", 6 pgs.

(Continued)

*Primary Examiner* — Fredrick Conley

(57) ABSTRACT

Implementations of the present invention comprise infant feeding pillows having a main portion and a wedge portion. The top surface of the main portion can be configured to support at least the arm of a user and, optionally, at least a portion of the head of an infant. The wedge portion can be coupled to and extend from the first side of the main portion. The width of the wedge portion decrease from a base portion to a tip portion as the distance from the first side of the main body increases. Additionally, a top surface of the wedge portion forms an angle with the top surface of the main portion. The wedge portion is configured to rest in the lap of a user and supports at least a portion of an infant. The main portion can further comprise a first and a second shoulder extending seamlessly from the main body along the longitudinal axis thereof.

20 Claims, 10 Drawing Sheets

(56) References Cited

OTHER PUBLICATIONS

"U.S. Appl. No. 14/733,405, Notice of Allowance mailed Oct. 26, 2015", 5 pgs.
"U.S. Appl. No. 14/733,405, Response filed Sep. 29, 2015 to Ex Porte Quayle Action mailed Jul. 29, 2015", 4 pgs.

* cited by examiner

INFANT FEEDING PILLOW

CROSS-REFERENCE TO RELATED APPLICATION

This application is a continuation of U.S. patent application Ser. No. 14/733,405, filed Jun. 8, 2015 and entitled "Infant Feeding Pillow, which is continuation-in-part of U.S. patent application Ser. No. 14/243,885, filed Apr. 2, 2014 and entitled "Infant Feeding Pillow", which claims the benefit of U.S. Provisional Application No. 61/807,373, filed Apr. 2, 2013 and entitled "Arm and Infant Support Pillow for Feeding and Other Applications." The disclosure of each of the above-referenced applications are hereby incorporated by reference in their entireties.

BACKGROUND

Field of the Invention

Implementations described herein relate to infant feeding pillows for use during nursing or bottle feeding that provide support for the infant and the user.

Related Art

Breastfeeding is known to improve the health and encourage proper growth and development of an infant. Breast milk provides the ideal amount of nutrition for infants with the proper mix of vitamins, protein and fat. Breast milk is known to be digested more easily than formula and can aid in the maturing of the infant's immune system. Breastfeeding is also known to supply an infant with valuable antibodies that can defend against illness. Even further, breastfeeding reduces the incidence of asthma and promotes optional brain development. Studies have shown that breastfed infants have less frequent and shorter episodes of illness. Additionally, the sucking action of the infant aids in dental development as well as development of the infant's facial bones and oral muscles. Conversely, lack of nursing increases the risk of childhood diabetes, cancers, ear infections, obesity and respiratory infections. In other aspects, the skin-to-skin contact encouraged by nursing offer infants emotional security and encourages bonding.

In yet other aspects, research has shown that nursing also offers health benefits for mothers. Increased levels of oxytocin stimulate uterine contractions, helping the uterus return to a pre-pregnancy size, decreasing blood loss and encouraging uterine toning. Nursing also burns additional calories and increases the rate of weight loss in most nursing mothers. Mothers who nurse their infants have a lower risk of developing osteoporosis and breast, ovarian and uterine cancers. Additionally, nursing allows a mother to feed her infant during times that normal supplies of food and water are not available.

During feedings, caregivers typically choose to sit in a chair, rocking chair or on a bed and hold the infant in their arms with the head of the infant resting in the elbow region of the arm and the infant's body on the caregiver's lap. Feedings can be performed over 1000 times in the first three months of life alone. Both feeding actions of breast and bottle feeding can result in the caregiver experiencing arm, upper back, shoulder and neck pain and stress and such effects are only worsened by the extended time of feeding. Injury and discomfort due to feeding can result in the caregiver making adjustments that result in improper positioning of the infant, making latching onto the nipple difficult which can, in turn, cause nipple irritation and soreness for a nursing mother. Also, carpal tunnel syndrome and tendonitis can result from repetitively gripping, lifting and positioning the wrist during feeding.

In order to receive the most positive outcome from nursing, it is very important for the infant to latch onto the nipple in an optimal position. While nursing, the mothers nipple should be aligned to the mouth of the infant. Misalignment of the nipple to the infant's mouth often leads to discomfort due to nipple irritation and soreness as well as frustration. It is also important for the caregiver to be appropriately supported to prevent the development of strain and injury.

In the past, infant feeding pillows have been provided as an aid for feeding an infant. However, these prior art infant feeding pillows typically require the use of the arm of the caregiver to hold the infant's head. Thus, such prior art infant feeding pillows do not prevent strain and injury to the arm and elbow of a caregiver. Some prior art infant feeding pillows are designed to be placed around the waist of a caregiver and, optionally, secured with the use of a fastener. Such a configuration can be bulky and cumbersome as well as fail to accommodate a wide range of body types. Also, prior art infant feeding pillows do not provide adequate support for the caregivers arm during post-feeding activities such as burping. Even further, such prior art pillows are generally no longer used once an infant no longer requires breast or bottle feeding.

Thus, there is a need for an infant feeding pillow that enables proper positioning and support of both the infant and caregiver.

SUMMARY OF THE INVENTION

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, an infant support pillow comprising a body comprising a main portion and a wedge portion is provided. The main portion of the body can have a top surface, a first side and a longitudinal axis. The top surface of the main portion can be configured to support at least the arm of a user and, optionally, at least a portion of the head of an infant. The wedge portion can be coupled to and extend from the first side of the main portion in a plane transverse to the longitudinal axis of the main portion. A width of the wedge portion can decrease from a base portion to a tip portion as the distance from the first side of the main body increases. Additionally, a top surface of the wedge portion can form an angle with the top surface of the main portion. Further, the wedge portion can be configured to rest in the lap of a user and can be configured to support at least a portion of an infant. In a further embodiment, the main portion can further comprise at least one of a first and a second shoulder extending seamlessly from the main body along the longitudinal axis thereof.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the present disclosure and together with the description, serve to explain the principles of the present disclosure. Like numbers represent the same elements throughout the figures.

DETAILED DESCRIPTION

Figure 1A:
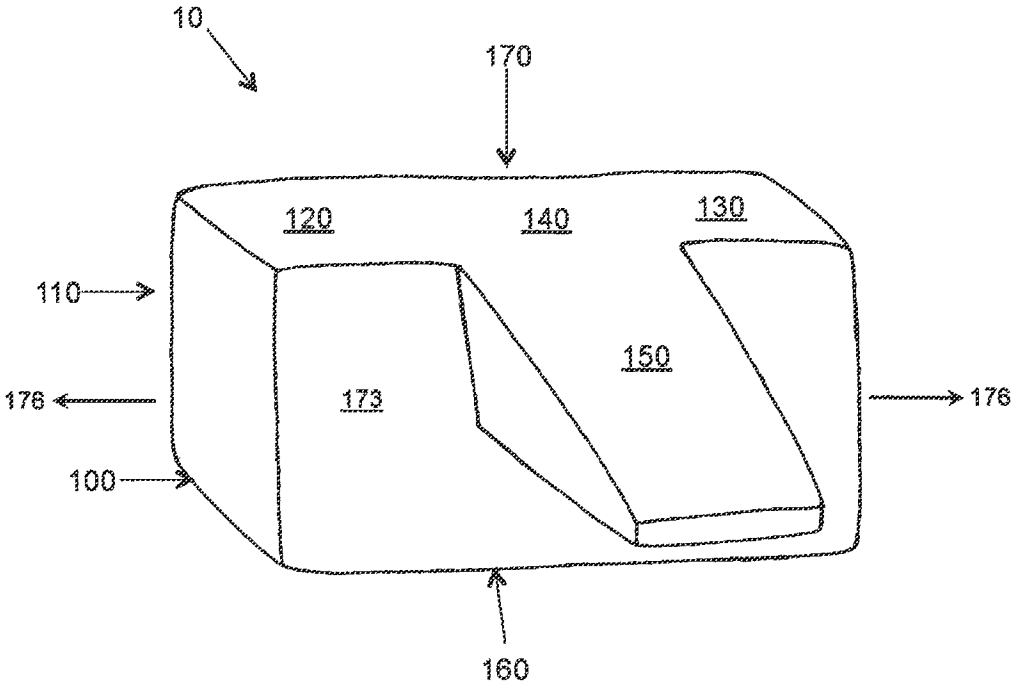
FIG. 1A illustrates a perspective view of an exemplary infant feeding pillow in accordance with the present invention.
Figure 1B:
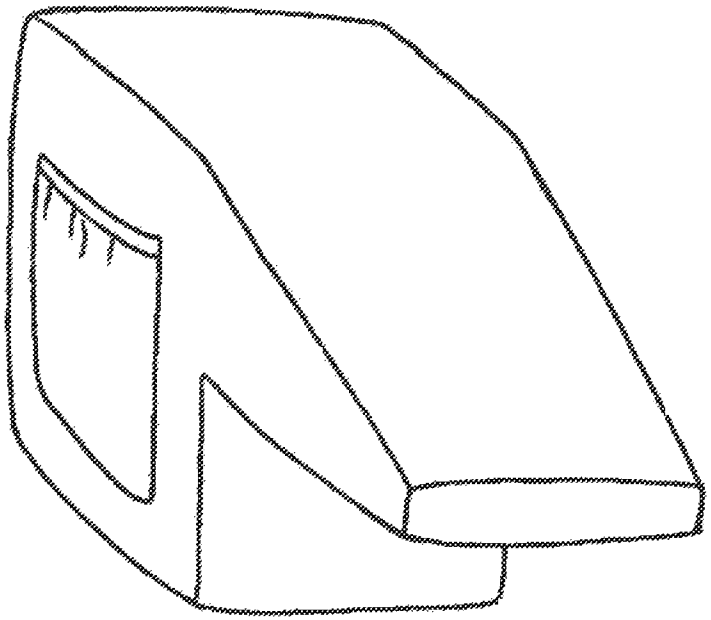
FIG. 1B illustrates a perspective view of another exemplary infant feeding pillow in accordance with the present invention.
Figure 2:
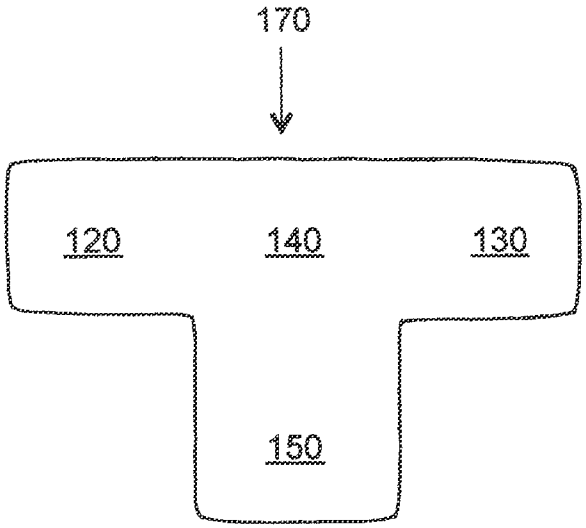
FIG. 2 illustrates a top view of the support pillow of FIG. 1.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a texture mark" can include two or more such texture marks unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

In one broad aspect, the present disclosure comprises an infant feeding pillow and associated methods. More particularly, in one aspect the present disclosure comprises an infant feeding pillow having a body comprising a main portion configured to support at least the arm of a caregiver and a wedge portion configured to support at least a portion of the infant. In a further aspect, the main portion is further configured to support at least the head of an infant. In another further aspect, the wedge portion is further configured to support at least a portion of the infant's body and, optionally, at least a portion of the infant's head. In light of the present disclosure, one skilled in the art will appreciate the infant feeding pillow described herein will provide ergonomically advantageous positioning of both a caregiver and an infant during feeding among other benefits.

In one aspect and referring to FIGS. 1A-3, an infant feeding pillow 10 comprises a pillow 10 having a cover 100, zipper 160, and pillow shell 180 filled with resilient fill material 190. In one aspect and as illustrated in FIG. 1B, the feeding pillow 200 comprises a main portion 140 and a wedge portion 150. The main portion 140 can have a top surface 170, a first side 173 and a longitudinal axis 176. In some aspects, the top surface 170 can be configured to support an arm of a caregiver. In other aspect, the wedge portion 150 is coupled to and extends from the first side 173 of the main portion 140 in a plane that is transverse to the longitudinal axis thereof. In further aspects, the width of the wedge portion 150 decreases from a base portion to a tip portion as the distance from the first side of the main body increases. In other aspects, a top surface of the wedge portion 150 forms angle with the top surface 170 of the main body 140. In other aspects, the wedge portion 150 can be configured to rest in the lap of a caregiver and, in additional or alternate aspects, can be configured to support at least a portion of an infant. In further aspects, the main body 140 can further comprise at least one of a first shoulder 120 and a second shoulder 130, wherein each of the first and second shoulders extend seamlessly from the main body along the longitudinal axis thereof. In a further aspect, the main body comprises the main body 140, the first shoulder 120 and the second shoulder 130.

It is contemplated that, in this aspect, the main body extends along a longitudinal axis from a first end to a second end. In one aspect, the main body extends a length of from about 16 inches to about 20 inches and, more preferably, about 22 inches. In another aspect, the main portion has a width of from about 4 inches to about 12 inches and, more preferably, about 5 inches. In another aspect, the main portion has a height of from about 6 inches to about 16 inches and, more preferably, about 10 inches, In yet other aspects, the wedge portion can have a height of from about 4 inches to about 14 inches and, more preferably, about 7 inches.

In aspects, the wedge portion 150 can have an inclined top surface. In further aspects, the inclined top surface can have a length of from about 3 inches to about 16 inches and, more preferably, from about 10 inches to about 11 inches. In other aspects, the wedge portion can have a bottom surface. In further aspects, the bottom surface can have a length of from about 2 inches to about 14 inches and, more preferably, from about 7 inches to about 8 inches.

In one aspect, the wedge portion 150 substantially defines an isosceles triangle in cross-section transverse to the longitudinal axis. In an alternate aspect, the wedge portion 150 substantially defines a right triangle in cross-section transverse to the longitudinal axis.

Figure 3:
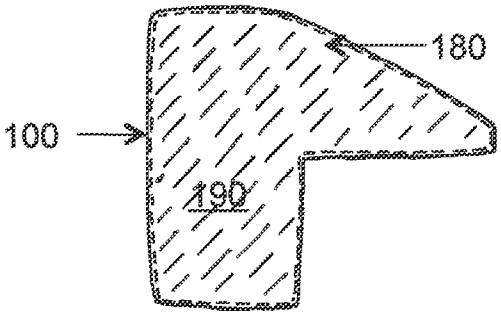
FIG. 3 illustrates a cross-sectional side view of the support pillow of FIG. 1.

In one aspect illustrated in at least FIG. 3, the infant feeding pillow 10 further comprises a resilient fill material 190. In further aspects, the resilient fill material can comprise at least one of cotton, polyester fiber, foam, feathers, beads, wool, viscoelastic material, buckwheat and beans. In further aspects, the foam can comprise, for example and without limitation, at least one of an open cell foam, a closed cell foam, a natural latex rubber foam, a memory foam, viscoelastic foam and the like. In further aspects, beads can comprise, for example and without limitation, polystyrene beads and the like. In additional or alternate aspects, the resilient fill material can comprise at least one of a natural material and a synthetic material.

Figure 9:
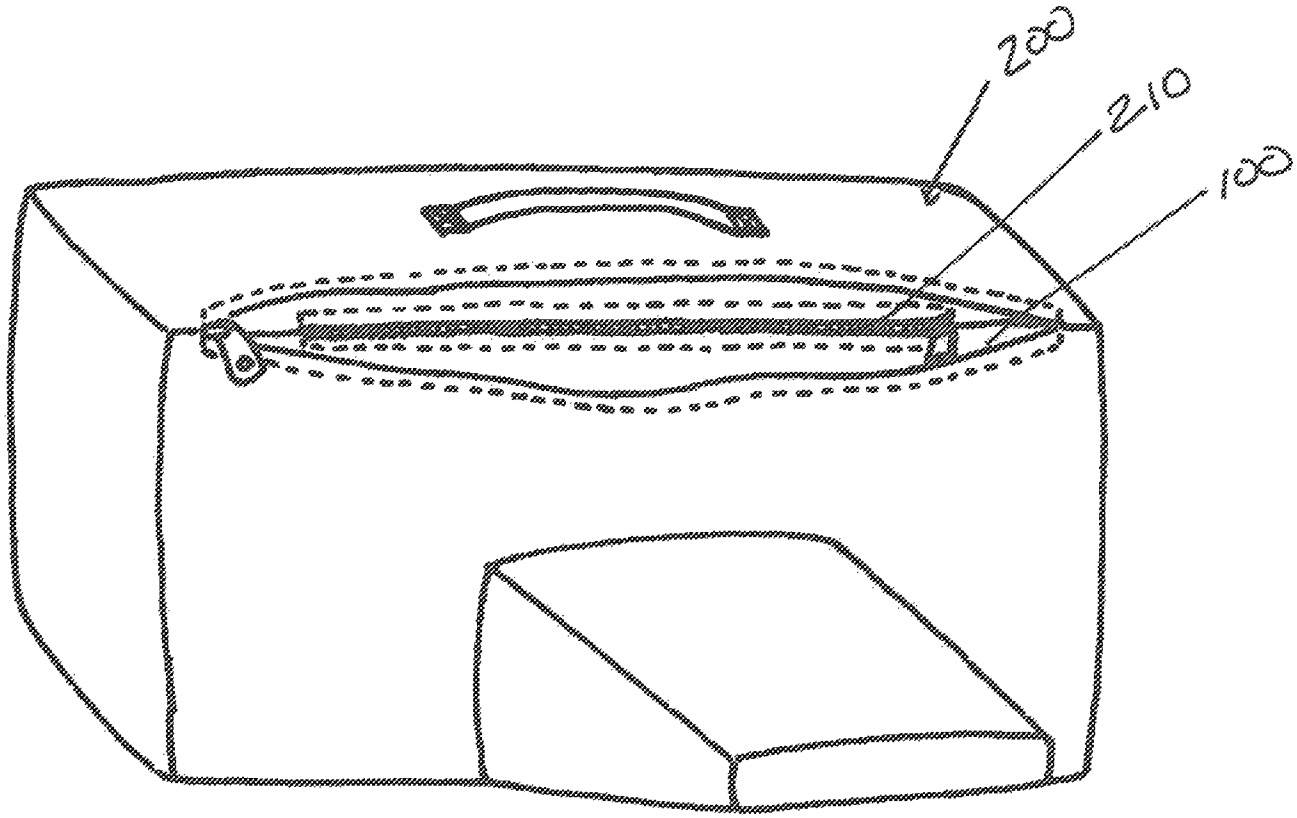
FIG. 9 illustrates a perspective view of an exemplary nursing pillow having a pillow insert having a port to access the pillow fill.
Figure 10:
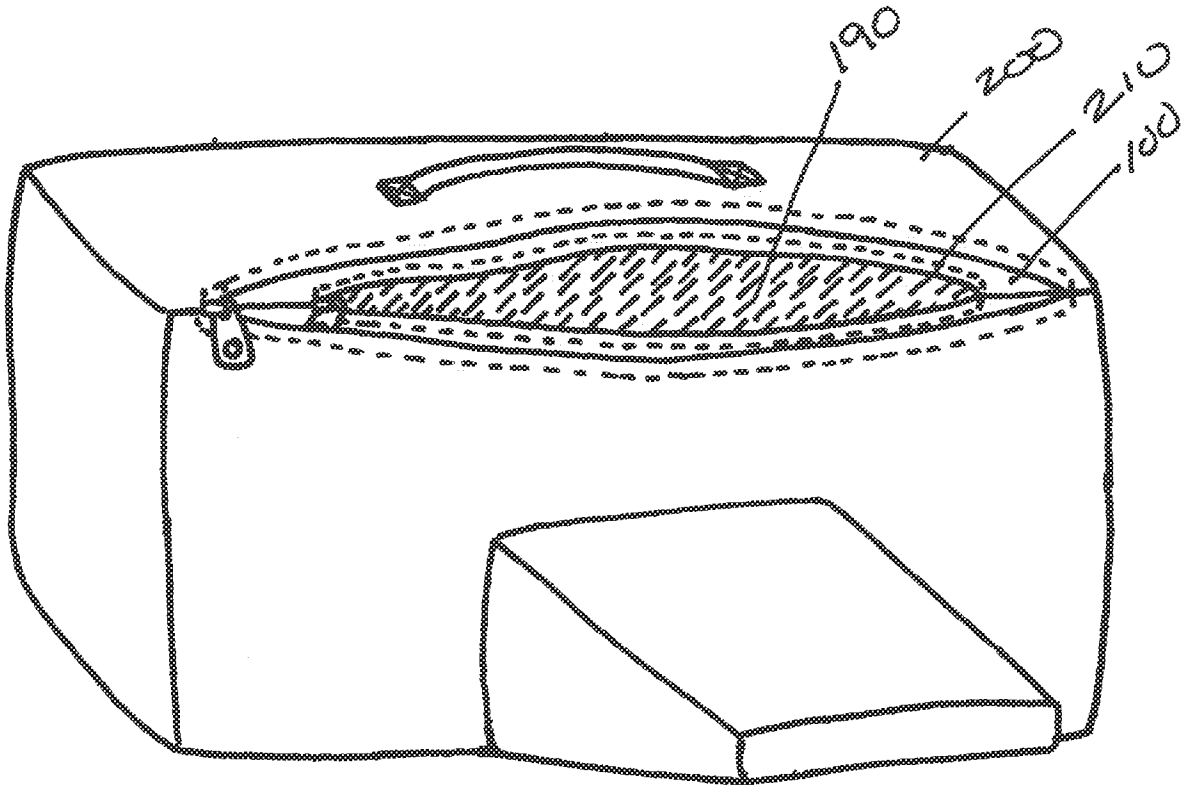
FIG. 10 illustrates a perspective view of the nursing pillow of FIG. 9 having the port opened to expose the pillow fill.

In another aspect, the infant support pillow further comprises a cover 100 substantially sized and shaped conform to the infant feeding pillow body. In additional or alternative aspects, the cover 100 can be water resistant, waterproof, stain resistant and the like. In further aspects, as illustrated in FIGS. 9 and 10, the cover can have a port 210 allowing access to the resilient fill material 190. In a further aspect, the port can comprise a re-closable opening. In an even further aspect, the re-closable opening can be selectively openable and closable between an open position and a closed position. It is further contemplated that, when the re-closable opening is at least partially opened, a user can add or remove fill material 190 in order to adjust the fill level of the infant feeding pillow. One skilled in the art will appreciate that such a feature can allow a user to tune at least the firmness of the pillow to a preferred level.

Figure 8:
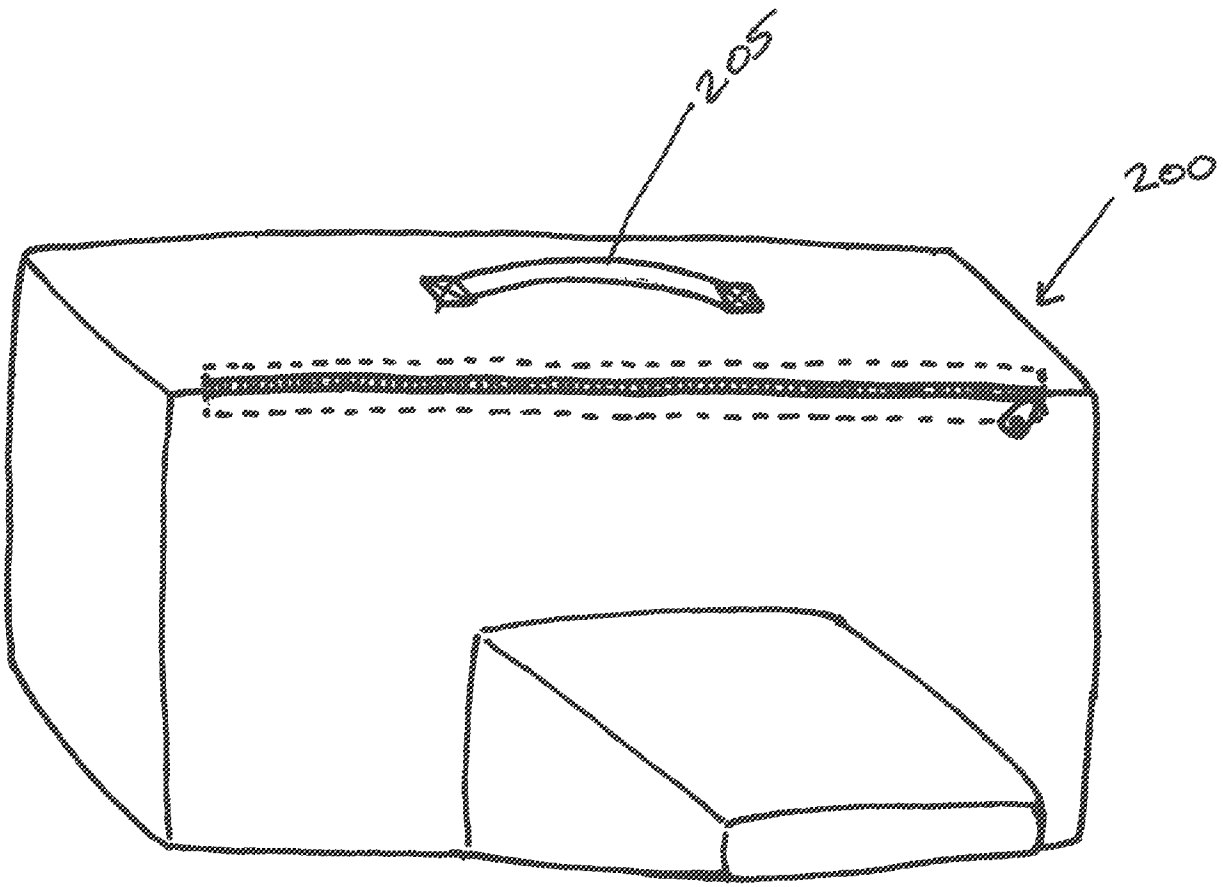
FIG. 8 illustrates a perspective view of an exemplary nursing pillow having a removable cover.

It is further contemplated that the nursing pillow can further comprise a secondary cover 200, as shown in FIG. 8. In further aspects, the secondary cover can be removable. In additional or alternative aspects, the secondary cover 200 can be water resistant, waterproof, stain resistant and the like. One skilled in the art will appreciate that such a feature lends itself to a number of benefits such as ease in cleaning and the ability of a user to select a secondary covering having a particular pattern.

In yet other aspects illustrated in FIG. 8, the infant feeding pillow can further comprise a handle 205.

Figure 4:
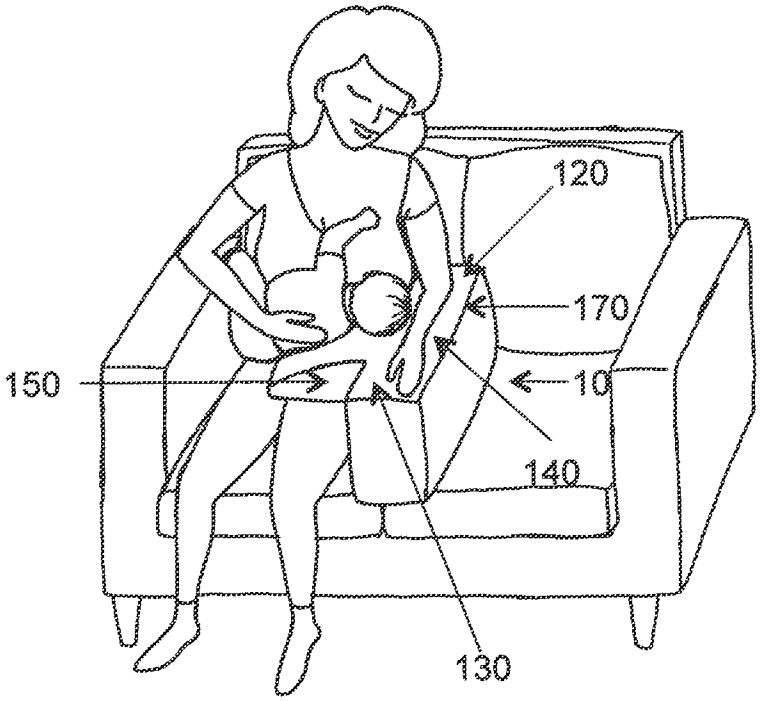
FIG. 4 illustrates the operation of the support pillow of FIG. 1, showing a user supporting an infant while nursing.
Figure 5:
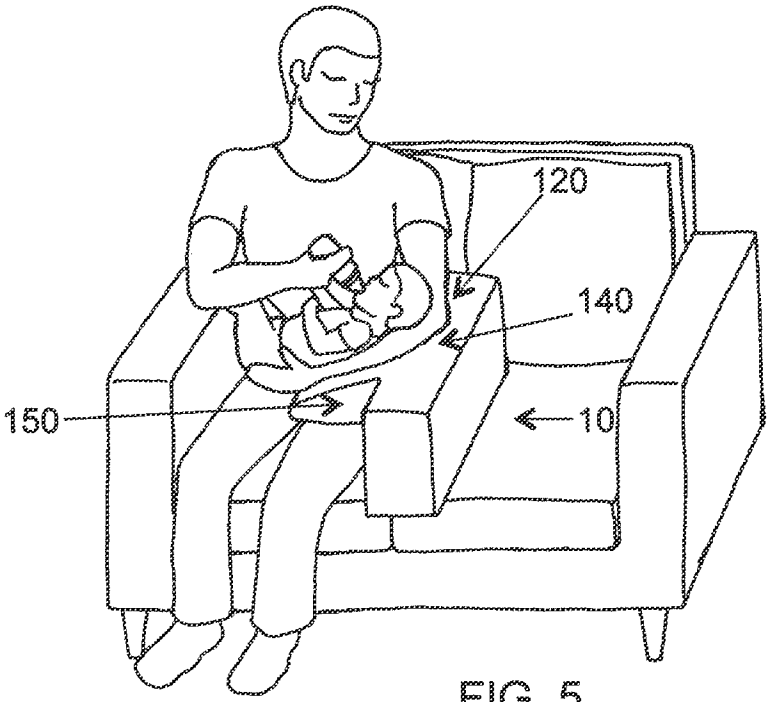
FIG. 5 illustrates the operation of he support pillow of FIG. 1, showing a user supporting an infant while bottle feeding.

In a further aspect and as illustrated in FIG. 4, a methodology for using the infant feeding pillow for a mother nursing an infant is contemplated. Feeding pillow 10 can be positioned at the mother's side with the wedge portion 150 placed on the mother's lap and configured to provide support for both the mother and the infant. The mother's elbow rests on top surface 170 which can be main body 140 or the main body optionally seamlessly connected to at least one of a first shoulder 120 and a second shoulder 130. At least a portion of the infant rests on the wedge portion 150 in a matter allowing alignment of the nipple of the mother and the mouth of the infant. Thus, as one skilled in the art will appreciate in light of the present disclosure, the mother and infant are both positioned in an ergonomically advantageous position for breastfeeding. Similarly, FIG. 5 depicts a methodology for using the infant feeding pillow for a caregiver bottle feeding an infant. It is contemplated that the wedge portion can be sized and shaped such that a the tailbone of a young infant can be adjacent to the tip portion of the wedge portion 150 and that, as the infant increases in length, the infant's torso can gradually rest on the caregiver's lap.

Thus, one skilled in the art will appreciate in light of the present disclosure that the main portion 140 and the wedge portion 150 comprise a comfortable inclined surface for the infant to lie on while feeding and position the infant's head at breast level of the nursing mother, allowing for optimal positioning for latching. In other aspects, the top surface 170 provides a surface on which a caregiver can comfortably rest their elbow adjacent to the infant's head so that the infant's head lies in the bend of the arm of the caregiver. It is contemplated, among many other benefits, that the infant feeding pillow 10 can be used by caregivers who have had C-sections without placing strain on the incision, further causing pain, irritation and increased healing time. In additional or alternative aspects, it is further contemplated that positioning the infant on an inclined surface both during and subsequent to feeding can reduce or eliminate acid reflux or otherwise aid in digestion. It is even further contemplated that the infant feeding pillow 10 have the appearance of a decorative pillow or a toss pillow when placed on furniture.

Figure 6:
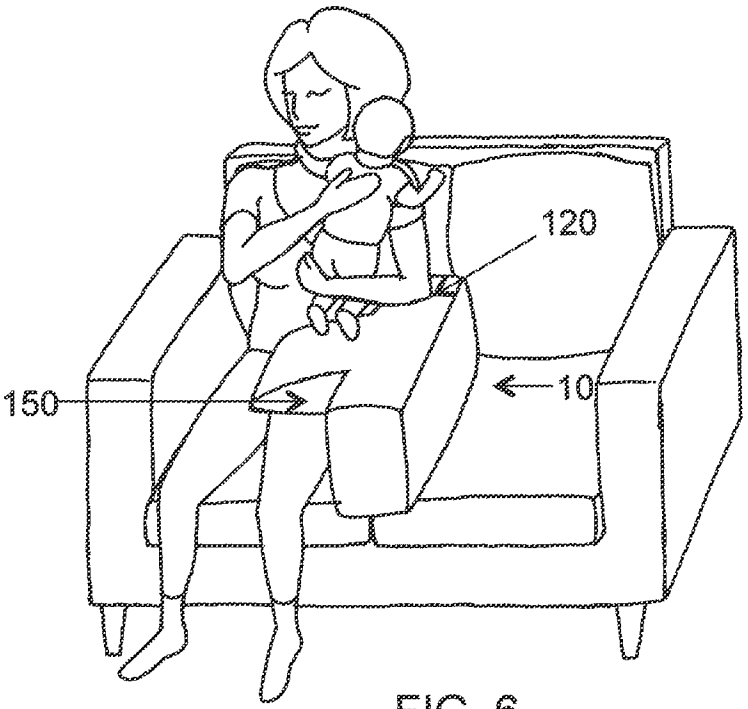
FIG. 6 illustrates the operation of he support pillow of FIG. 1, showing a user burping an infant.

In a further aspect and as illustrated in FIG. 6, a methodology for using the infant feeding pillow to burp an infant is contemplated. Feeding pillow 10 can be positioned as in FIGS. 5 and 6, and the caregiver's arm can rest on the upper surface 170 for support as the infant is positioned on the shoulder area of the caregivers body. Providing support for the arm of the caregiver can relive stress on the caregiver's arm, back and shoulders caused by the weight of the infant being suspended on the caregiver's upper body.

Figure 7:
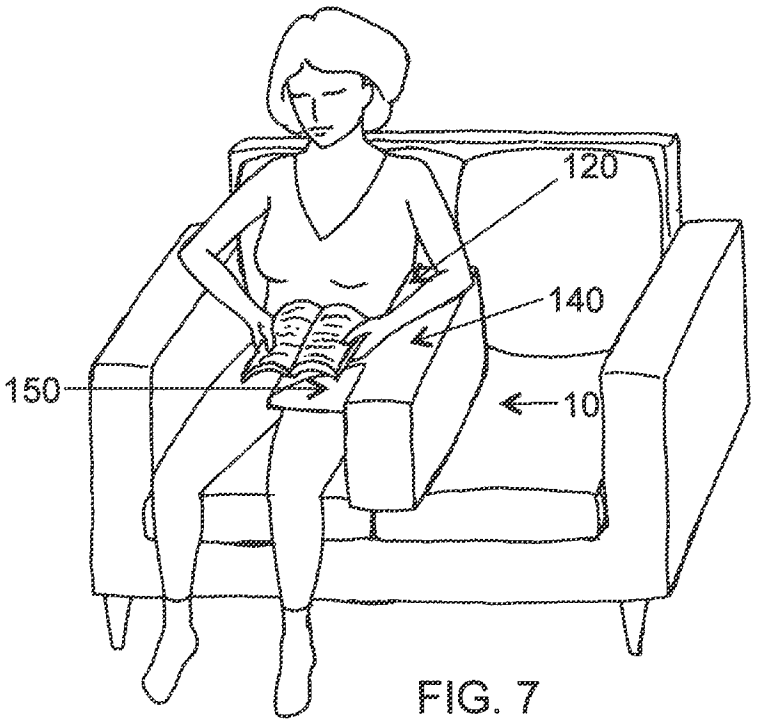
FIG. 7 illustrates the operation of the support pillow of FIG. 1, showing a user reading.

In another aspect and as illustrated in FIG. 7, the infant feeding pillow can have uses extending beyond infant feeding. Here, it is contemplated that the infant feeding pillow 10 can be used for ergonomic positioning when, for example and without limitation, reading a book and the like.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An infant support pillow, comprising:

a main portion having a top surface, a bottom surface, and a first side having a length, wherein the first side extends between the top surface and the bottom surface, wherein the main portion further comprises a longitudinal axis extending from a first end to an opposed second end of the main portion, wherein the main portion extends to and rests upon a surface upon which a user rests; and a wedge portion having a top surface and a bottom surface, wherein the wedge portion is coupled to and extends away from the first side of the main portion, wherein a width of the wedge portion decreases from a base portion to a tip portion as the distance from the first side of the main body increases, and wherein a bottom surface of the wedge portion extends from the first side of the main portion at a distance measured from the top surface of the main portion that is less than the length of the first side of the main portion.

2. The infant support pillow of claim 1, wherein the infant support pillow further comprises a resilient fill material.

3. The infant support pillow of claim 2, wherein the resilient fill material comprises at least one of cotton, polyester fiber, foam, feathers, beads, wool, viscoelastic material, buckwheat, and beans.

4. The infant support pillow of claim 2, wherein the resilient fill material comprises at least one of a natural material and synthetic material.

5. The infant support pillow of claim 1, wherein the infant support pillow further comprises a cover substantially sized and shaped to conform to the combined main portion and wedge portion.

6. The infant support pillow of claim 1 wherein the wedge portion substantially defines an isosceles triangle in a cross-section that is transverse to the longitudinal axis of the main portion.

7. The infant support pillow of claim 1, wherein the wedge portion substantially defines a right triangle in a cross-section that is transverse to the longitudinal axis of the main portion.

8. The infant support pillow of claim 1, wherein the main portion further comprises at least one of a first shoulder and an opposed second shoulder extending from the main body along the longitudinal axis.

9. The infant support pillow of claim 8, wherein the distance between the first end and the second end of the main portion measures from about 16 inches to about 26 inches.

10. The infant support pillow of claim 9, wherein the main portion has a length of about 22 inches.

11. The infant support pillow of claim 1, wherein the main portion has a width of from about 4 inches to about 12 inches.

12. The infant support pillow of claim 11, wherein the main portion has a width of about 5 inches.

13. The infant support pillow of claim 1, wherein the main portion has a height of from about 6 inches to about 16 inches.

14. The infant support pillow of claim 13, wherein the main portion has a height of about 10 inches.

15. The infant support pillow of claim 1, wherein the edge portion has a height of from about 4 inches to about 14 inches.

16. The infant support pillow of claim 15, wherein the wedge portion has a height of about 7 inches.

17. The infant support pillow of claim 1, wherein the top surface of the wedge portion has a length of from about 3 inches to about 16 inches.

18. The infant support pillow of claim 17, wherein the top surface of the wedge portion has a length of from about 10 inches to about 11 inches.

19. The infant support pillow of claim 1, wherein the bottom surface of the wedge portion has a length of from about 2 inches to about 14 inches.

20. The infant support pillow of claim 19, wherein the bottom surface of the wedge portion has a length of from about 7 inches to about 8 inches.

* * * * *